United States Patent [19]

Hasenbalg

[11] Patent Number: 4,785,611

[45] Date of Patent: Nov. 22, 1988

[54] CARTON PACKAGING

[76] Inventor: Ralph Hasenbalg, 8635 Rudnick Ave., Canoga Park, Calif. 91304

[21] Appl. No.: 938,007

[22] Filed: Dec. 4, 1986

[51] Int. Cl.[4] ..... B65B 5/10; B65B 23/02

[52] U.S. Cl. ..... 53/536; 53/251; 53/538; 53/544

[58] Field of Search ..... 53/247, 535, 248, 536, 53/251, 538, 252, 540, 475, 544

[56] References Cited

U.S. PATENT DOCUMENTS

| | | | |
|---|---|---|---|
| 2,821,822 | 2/1958 | Mapes | 53/536 X |
| 2,825,193 | 3/1958 | Loveridge | 53/536 |
| 2,830,416 | 4/1958 | Edwards et al. | 53/536 |
| 3,252,265 | 5/1966 | Small et al. | 53/544 X |
| 4,003,185 | 1/1977 | Goff . | |
| 4,104,846 | 8/1978 | Waller . | |
| 4,192,121 | 3/1980 | Caudle . | |
| 4,439,099 | 3/1984 | Asari et al. | 53/536 X |
| 4,512,137 | 4/1985 | Koberlein | 53/544 X |
| 4,630,428 | 12/1986 | Lesch | 53/251 X |

FOREIGN PATENT DOCUMENTS

| | | | |
|---|---|---|---|
| 505543 | 5/1939 | United Kingdom | 53/536 |
| 1314057 | 4/1973 | United Kingdom | 53/475 |
| 2009702 | 6/1979 | United Kingdom | 53/536 |

*Primary Examiner*—James F. Coan
*Assistant Examiner*—Steven P. Weihrouch
*Attorney, Agent, or Firm*—Sheldon & Mak

[57] ABSTRACT

Apparatus, particularly, for packing egg cartons into wire baskets includes a movable tray for delivering cartons to a basket filling station where the cartons are lowered into the basket. Tines support the cartons after the movable tray is withdrawn and a movable press urges the cartons downwardly onto the tines while the tines move downwardly. The sequence is repeated and layers of cartons are progressively added to fill the basket. A sensor determines when the baskets are full and removes full baskets and replaces new baskets for filling. The basket filling station is fed from multiple filling trays fed by multiple conveyors.

16 Claims, 3 Drawing Sheets

FIG. 4
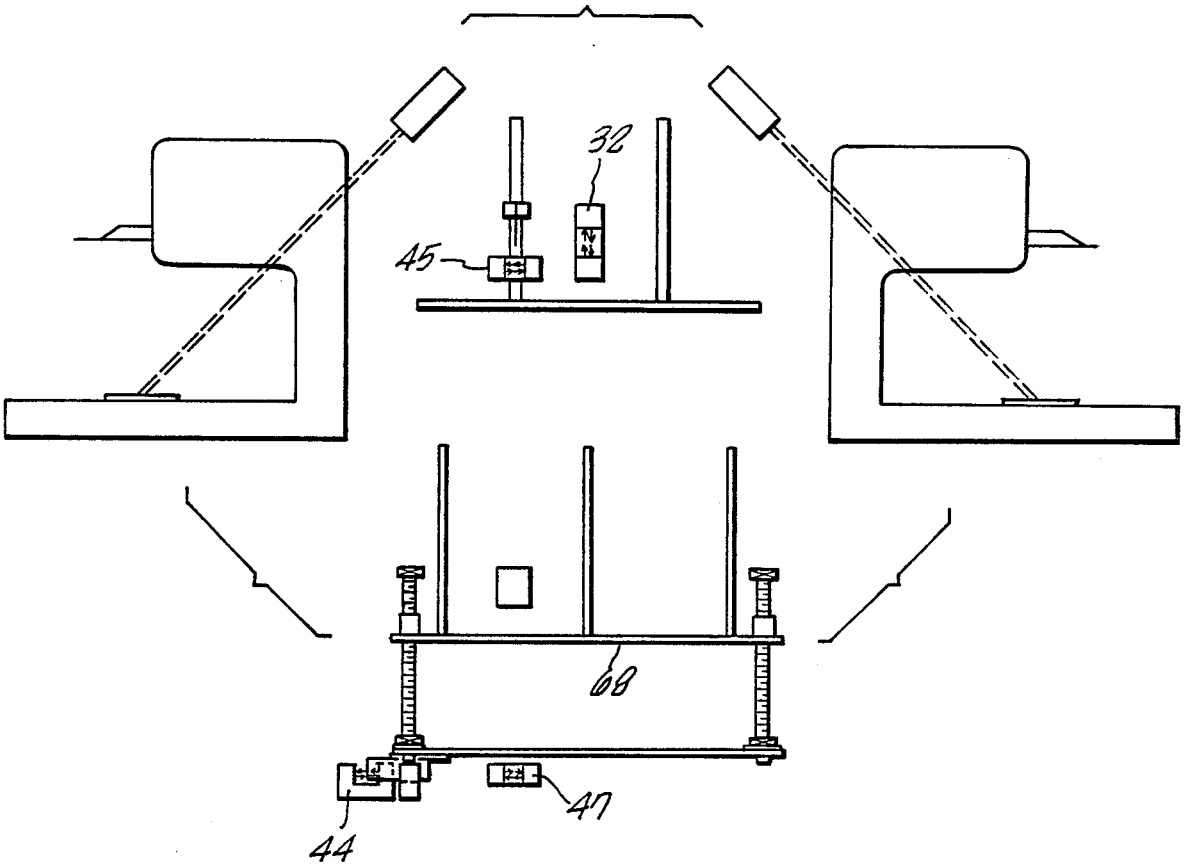
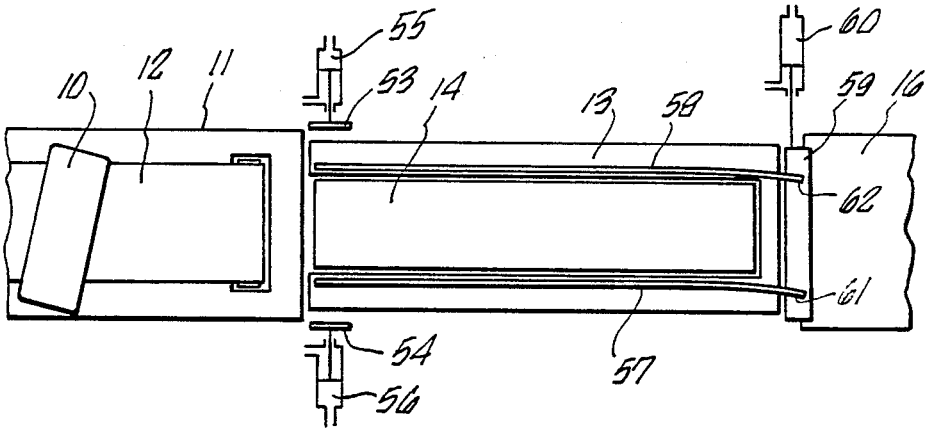
FIG. 5

CARTON PACKAGING

BACKGROUND OF THE INVENTION

This invention relates to packing elements into larger containers. In particular, the invention relates to packing egg cartons into wire baskets.

Existing equipment is available to grade size and package eggs in egg cartons automatically. Before the cartons are shipped to market the cartons are packed in turn in wire baskets for protection against crushing.

Different devices have been developed for automatically packing cartons such as egg cartons into baskets or crates. Difficulties however arise in the automatic feed, and the tendency of the cartons to catch on the sides of the baskets. This results in breakage or mispacking. Moreover, the system to control the drop of cartons into the basket requires generally complex electronics to control the packaging operation. Other automatic systems which are available provide other difficulties, for instance, in not being adaptable to different size cartons for packing in the basket. In the Applicant's knowledge there is currently no system which is available for effectively achieving the objective of automatically packaging egg cartons as described.

It is an object of the present invention to provide a packaging machine which overcomes problems of existing packaging apparatus and is particularly adaptable to packaging of egg cartons in wire or similar baskets.

SUMMARY OF THE INVENTION

Apparatus for packing articles such as egg cartons in a basket or crate comprises a movable tray for delivering cartons from a loading position to an unloading position above the basket mouth. The basket is located at a basket filling station. At the station there are movable supports in the form of tines extending upwardly from a lower position through the basket whereby the free ends of the tines support the cartons from underneath on removal of the tray from over the basket. At the filling station, above the cartons is a removable press for progressively urging the cartons downwardly onto the support and into the basket for discreet distances. The supporting tines simultaneously move downwardly into the basket. This operation is repeated as the basket is loaded with cartons.

Layers are counted as the basket fills and, when a basket is full, the basket is thereupon removed from the filling station by conveyor means. A new basket is replaced at the filling station and the filling sequence is repeated.

The invention is described with reference to egg carton packaging as exemplary of different articles which can be packaged in a basket or crate in the uniform controlled manner. The control for the loading is affected by a microprocessor-computerized system and appropriate sensors for optically determining the positions of different elements in the loading apparatus. The invention is directed to both the apparatus and method for packaging articles into the basket.

The invention is further described with reference to the drawings.

BRIEF DESCRIPTION OF THE DRAWINGS

FIG. 4 is a diagrammatic illustration of the sensors for the egg packaging apparatus;

FIG. 5 is a top view of the escapement conveyor being fed from the carton feed conveyor and the escapement conveyor feeding the movable tray.

DETAILED DESCRIPTION OF PREFERRED EMBODIMENT

Figure 1:
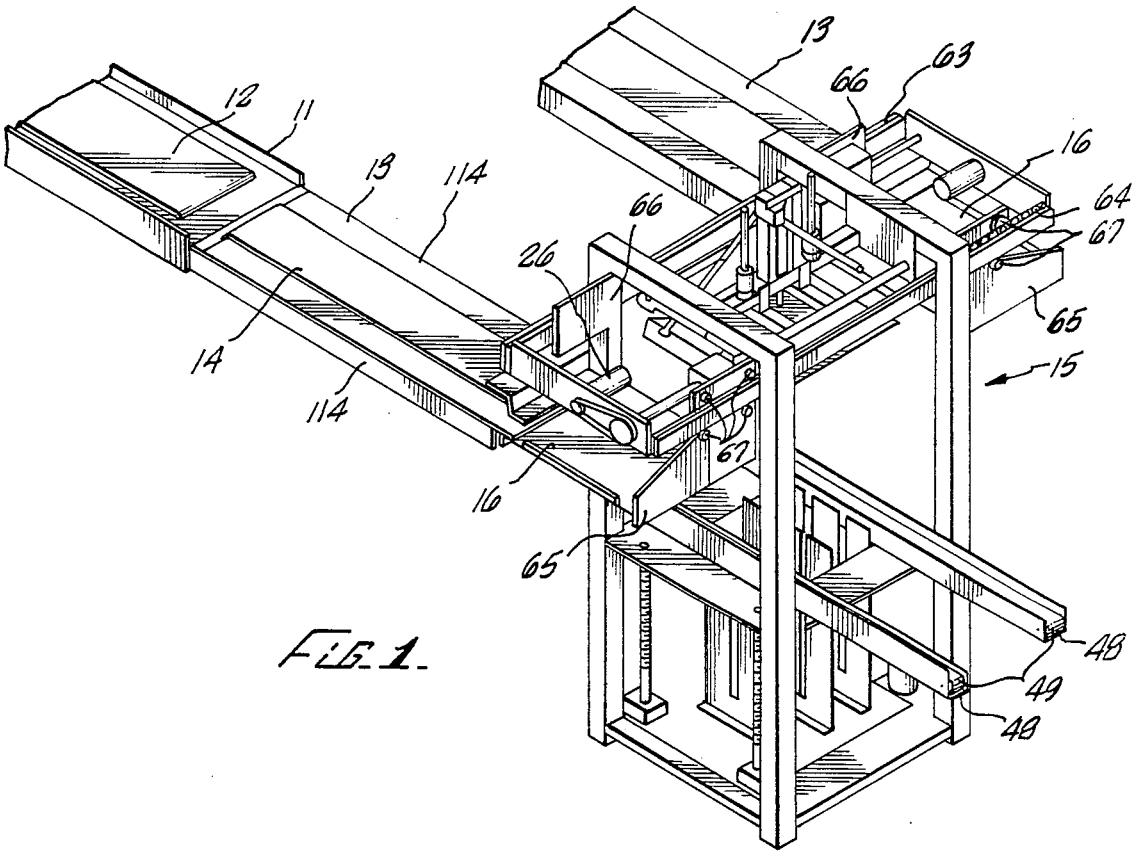
FIG. 1 is a perspective view of an egg packaging apparatus illustrating two feeding conveyors directed to a basket filling station of the packaging apparatus.
Figure 2:
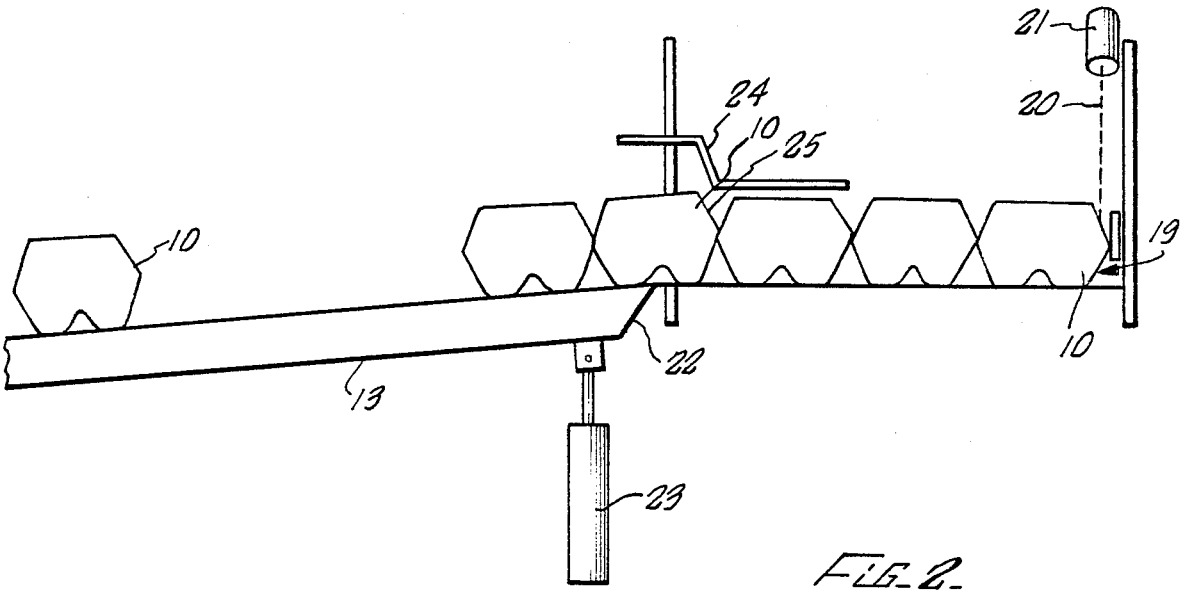
FIG. 2 is a side view illustrating the escapement conveyor system feeding the movable tray of the apparatus.

Apparatus for packing elements being egg cartons into a container being basket receives filled egg cartons 10 from delivery conveyors 11 at an egg processing plant. The conveyor 11 is illustrated in FIGS. 1 and 5 and includes a conventional belt conveyor system. At the delivery end of the conveyor 11 there is located an escapement conveyor 13 which includes an endless belt 14.

In the packaging apparatus of FIG. 1 there are shown two side-by-side escapement conveyors 13 in parallel arrangement feeding a basket filling station 15. Several escapement conveyors can be provided from different delivery conveyors 11 as required.

Figure 3:
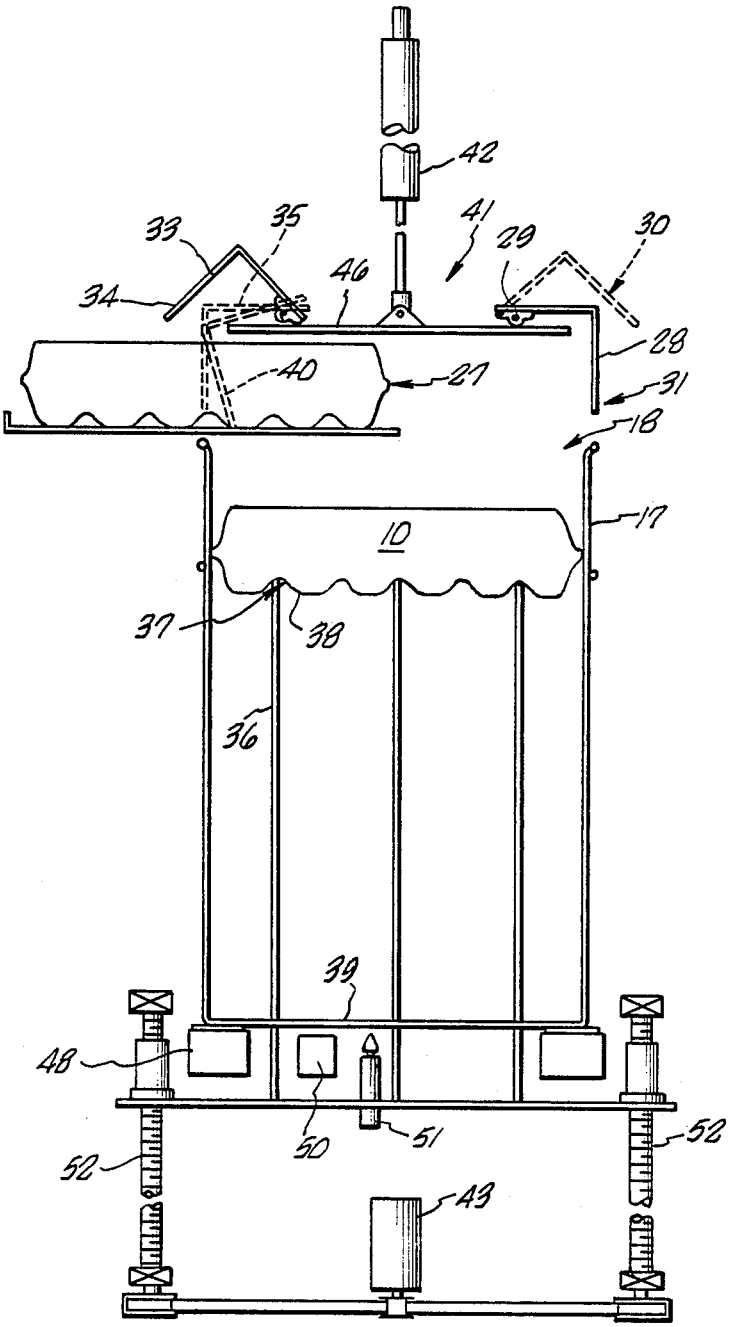
FIG. 3 is a mechanical schematic side view at the filling station showing the movable tray partly over a basket, with one carton load in the basket and another carton load being delivered to the top of the basket.

For simplicity, the description will refer to only a single delivery system from the escapement conveyor to a delivery tray 16 at the basket filling station 15. At the basket filling station 15 there is a movable tray 16 which is fed by the escapement conveyor 13. Similar apparatus and operations are effective for the associated parallel escapement conveyor and movable tray 16. The movable tray 16 delivers a load of egg cartons 10 from the loading position at the discharge point from the escapement conveyor 13 to an unloading position above a basket mouth at the basket filling station. The basket 17, as illustrated in FIG. 3, has a metallic wire or plastic configuration with a rim to the mouth 18 of the basket 17.

The tray 16 can accommodate three, one dozen, cartons which are urged from the escapement conveyor 15 onto the movable tray 16. When this happens the leading carton 10 at leading end 19 blocks reflection of light 20 to an optical module 21 thereby indicating that the movable tray 16 is full. The two outside sections of the discharge end 22 of the escapement conveyor 13 are lifted by a cylinder 23 such that the fourth carton 10 in line is lifted off of the belt 14 and abuts a stop plate 24 with the leading end 25 of the carton 10. This stops further delivery of cartons 10 onto the movable tray 16. At this time the movable tray 16 is rendered movable to a location over the mouth 18 of the basket 17.

The movable tray 16 is driven by a motor 26 to move from the escapement conveyor 16 discharge end 22 to a position over the mouth 18 of the basket 17. Activation of the motor causes the tray 16 to move to the position over the mouth 18.

When the tray 16 is located over the mouth 18, the leading end 27 of the forward egg carton 10 engages an oppositely located stop fence 28 which is hinged at 29 for movement between the position shown in solid line 31 and the position 30 shown in phantom which is raised. In the position shown by the solid line 31 the cartons are prevented from overshooting the far side of the basket 17. Power is supplied to the motor 26 until a signal is received that the movable tray 16 is over the basket mouth 18 from a position sensor 32. Power is then removed from the motor 26 and another fence 33 is moved from the position shown in solid line 34 to the position shown in phantom line 35 thereby in position to push off the cartons 10. The fences 28 and 33 are powered by air cylinders.

At this time the motor 26 driving the movable tray 16 is powered in a direction moving back towards the discharge end 22 of the escapement conveyor 13 where the tray can again be filled by cartons. As this happens the cartons 10 on the tray move against the cartons stop fence 33 and the tray 16 slides out from underneath them. The cartons 10 thereupon fall into the basket 17 and are supported on the free ends of movable supports which are a series of tines 36. When packing standard cartons, the free ends 37 locate in grooves or wells 38 which are the underneath formation of the cartons 10. The movable tines protrude upwardly through the bottom 39 of the basket 17.

When the movable tray 16 returns to the filling position 22, the optical module 21 receives light from a reflector on the tray and the tray 16 is stopped. The escapement conveyor 13 is lowered so that the cartons 10 again contact the belt 14 and the stop fence 24 does not impede further loading onto the tray 16. The operation for loading is then repeated.

Continuation of the packaging of the three cartons 10 into the basket is affected by ensuring that the cartons are not sitting on the rim of the mouth 18 to the basket 16. The fence 33 is activated by a second air cylinder to a location 40 shown in phantom wherein the fence shown in phantom position 40 aligns the cartons 10 relative to the basket 17. Both the carton stop fences 28 and 33 are then returned to the upwardly located position 30 and 34 respectively.

A movable press 41 is activated by a press cylinder 42 for urging the cartons 10 downwardly onto the supporting tine ends in the basket 17 for a discreet distance. The supporting tines 36 move progressively downwardly into the basket 17.

The supporting tines 36 ar activated by a motor 43 which can move the tines 36 upwardly and downwardly as required, and is preferably programmed to move in intervals of one carton height. The travel distance of the tines 36 is controlled by a two phase lead screw position encoder 44 and a Z-8 microprocessor. Once the carton press cylinder 42 is fully down as detected by a sensor 45, the cylinder 42 is again pressurized to return to its upwardly located position. After each discreet movement downwardly the panel or plate 46 is then also withdrawn and the system is ready to receive second and subsequent layers of egg cartons from either of the escapement conveyors 13. In the illustrated apparatus five layers of cartons 10 are packed as described. After the fifth layer the carton support tines 36 are located in a position below the bottom 39 of the basket 17 as detected by sensor 47.

At this time, basket conveyor 48 is activated whereby a basket 17 is removed from the basket filling station 15. The basket conveyor 48 includes endless belts 49 which engage the bottom sides of the basket 17. An empty basket 17 is then brought to the basket filling station 15 to be filled by the next cycle. A basket stop cylinder 51 is pressurized to locate the incoming empty basket 17 at the correct location at the basket filling station 15. The sensor 50 signals the microprocessor that an empty basket 17 is in position for filling. The basket conveyor 48 is stopped and the carton lift tines 36 move upwardly through the basket bottom 39 under action of the motor 43 and the lead screws 52 to a packing position for the first layer of cartons 10.

A complete cycle of a system has been described. When the apparatus is first powered for a packing operation, the micro-processor goes through an initializing cycle where all elements of the system are conditioned to receive a basket 17 and egg cartons 10 for packing.

Cartons 10 on the conveyor belt 12 approaching the escapement conveyor 13 from the existing conveyors are generally off centered and skewed as illustrated in FIG. 5. At the feed end to the escapement conveyor 13 there are two fences 53 and 54 respectively which are driven by air cylinders 55 and 56 respectively simultaneously to center and straighten the cartons 10 as they enter the escapement conveyor 13. The two fences 53 and 54 move towards each other to center the cartons 10 and then relax to positions outside the bounds of the existing feed conveyor 11. Above the conveyor belt 14 on the escapement conveyor 13 are two guide rails 57 and 58 respectively which are longitudinally directed along the length of the escapement conveyor 13. The rails 57 and 58 are bolted to the escapement conveyor outside of the belt 14 and positioned to match the spacing between the egg wells or grooves in the bottoms of cartons 10. This also helps alignment by not allowing the cartons 10 to enter the escapement conveyor 13 until they are straight. An electronic oscillator connected to a four-way solenoid valve provides air for the cylinders 55 and 56.

At the transition point at the downstream end of the escapement conveyors 13 prior to entry onto the movable tray 16 there is an air driven jogging plate driven by an air cylinder 60 which moves at a rate of approximately one Hertz, which is the same rate as the fences 53 and 54. The jogging plate encourages cartons 10 to slide off the escapement conveyor belt 14 and to flow evenly onto the tray 16. The downstream ends of the guide rails 57 and 58 are bolted to the jogging plate at locations 61 and 62 so that the guide rails 57 and 58 also flex and move and this encourages further movement of the cartons 10.

The escapement conveyor 13 itself consists of two main parts which are separate from each other: namely, a center section 14 and outside sections 114 to either side of the center section 14. The center section 14, consisting of the gearhead drive motor, two belt rollers, bearings, the belt itself, and a supporting frame, are stationary, except for the belt mechanism during operation. The outside sections 114 pivot at the carton leading end on the same shaft that carries the entry end belt roller and moves at the discharge end to lift the cartons 10 off the belt on center section 14. Lifting the cartons 10 from the center section and belt 14 normally stops the carton flow, but when large numbers cartons 10 accumulate on the delivery conveyor 11, the carton stop 24 action is necessary.

The two carton movable trays 16 are supported by two rails 63 and 64 extending from the left to the right side of the machine. Both rails 63 and 64 are used by both trays 16. Each tray 16 hangs from a front plate 65 and a rear plate 66, each plate having four trolley wheels 67 t provide rolling attachment on the support rails 63 and 64. The trays 16 have right angle bends at their front and rear edges that bolt to the bottom edges of the front and rear plates.

The drive force to move the one tray 16 is supplied to the front plate 65 on one side of the machine and to the rear plate 66 on the other side to move the second tray 16. A large pulley, a motor, shaft with friction drive, and a small pulley on motor shafts provides drive and speed reduction for the trays 16. Bidirectional drive is obtained by reversing the direction of motor rotation. A stopple is provided on each tray 16 to position the cartons 10 correctly when the trays 16 are full.

Four trolley wheels, similar to the wheels used for each carton movable tray 16, are mounted to the frame of the machine to hold the press bar or plate 46 and thereby guide the press as it moves to push on the top of the cartons 10 into the basket 17. Force is supplied by the air cylinder 42, one end of which is fastened to the press assembly and the other end is fastened to the frame of the machine.

The conveyor 48 consists of two narrow belts 49 which pass from the front to the rear of the machine to hold the edges of the baskets 17 and leave most of the bottom of the basket 17 accessible from the bottom 39. The conveyor belts 49 are both driven by a common shaft and are fitted with vertical guide fences at their outer edges to keep the baskets 17 squared with the filling station of machine. The basket stop cylinder 51 is positioned at the front edge of the basket packing position at the filling station to stop precisely the baskets 17 at the filling station. A metal proximity detector 50 under the front edge of the basket filling position 15 signals the control microprocessor that the basket 17 is overhead. The basket conveyor motor is stopped after a basket 17 is in the filling position.

Lift is provided by three lead screws 52 and ball nut assemblies positioned in a triangle outside of the tines 36. The ball nuts are fastened to a tine support plate 68 and the lead screws 52 are held in bearing blocks mounted to the frame of the machine at their upper and lower ends. A drive is supplied to the lead screws 52 by a toothed belt passing around pulleys on their lower ends and a drive motor pulley. The toothed belt keeps the lead screws 52 in synchronism and thereby keeps the tines 36 precisely positioned during their travel into and out of the basket 17. A two phase position encoder 44 supplies signals that enable the control microprocessor-computer to keep track of the position of the tines 36 at all times.

Full baskets 17 are discharged by the conveyor 48 to a shelf, about 16 inches wide, in turn to be pushed onto a full basket cross conveyor. The cross conveyor carries filled baskets from other packing machines, and filled baskets are pushed onto the cross conveyor at a time when no baskets are passing in front of the packer position.

A self controlled ram system consisting of a ram, air cylinder, basket cross conveyor photo sensor, basket waiting photo sensor, and logic controller controls the flow of baskets to the cross conveyor. The ram is a rectangular frame having a round shaft as top and bottom members and tubing as the left and right side members. The top shaft is held by two pillow block bearings attached to the machine frame at a position above the point where baskets exit the packing machine. The bottom shaft carries a roller to allow easy vertical movement as the roller moves up the rear side of the full basket as it is pushed onto the cross conveyor. The cylinder acts upon a lever fastened to the top shaft to force rotation and ram action. If sensor signals tell the logic that a basket 17 is waiting to be pushed onto the cross conveyor and that no other basket is in front of the packer, the ram is activated and the full basket 17 is pushed onto the cross conveyor.

The packaging system for egg carton packaging has unique advantages. The tines are easily adapted to be accommodated in the grooves or wells forming the underneath of the cartons 10. Likewise the movable tray system with its fence guiding means ensures that the cartons are effectively packaged in the crate or basket without mispacking, and jamming on the sides. Consequently, the apparatus operates smoothly and effectively without causing damage or breakage to the fragile contents of the cartons. The support and press system working in unison effectively ensure positive movement and location of the cartons in each packaging crate or basket. The system is also readily adaptable to different size cartons.

The system is automatically controlled by a microprocessor-computer so that the movements of the various components is effected in the requisite sequence as signaled by various sensors of the apparatus.

While the invention has been particularly shown and described with reference to a preferred embodiment relating to egg carton packaging, many of the uses and modifications of the method of this invention will be apparent to those skilled in the art. The invention therefore is not to be limited other than by the legal scope of the following claims.

I claim:

1. Apparatus for packing elements into a container comprising:

an escapement conveyor for moving the elements from a delivery conveyor to a movable tray, the escapement conveyor including centering means to align elements prior to loading onto the movable tray;

the movable tray for delivering the elements from a loading position remote from a container mouth to an unloading position above the container mouth, said container being located at a container filling station;

a movable support at the filling station extending upwardly rom a lower position through the container whereby the free end of the support supports the elements from underneath on removal of the tray from the filling station, the movable support means being a series of tines, and the tines being elongated plates spaced discretely from each other wherein the free ends of the tines fit under grooves in the bottom of the elements, location of the tines being determined relative to the standard groove location in the base of the elements;

a movable press for urging the elements downwardly onto the support and into the container for a discreet distance after removal of the removable tray, the support moving simultaneously progressively downwardly into the container, and the press thereupon being upwardly movable after a predetermined press movement whereupon the movable tray, movable support and movable press sequence is repeatable for another element load to the container filling station; and a sensor for determining the element loading state of the container such that upon a predetermined loading of the container, the container is removed from the filling station.

2. Apparatus as claimed in claim 1 wherein the tines are supported on a plate movable upwardly and downwardly relative to the container.

3. Apparatus as claimed in claim 2, wherein the plate is supported by vertically disposed lead screws, the screws being located at least at three corners of a triangle, the screws being cooperative with a threaded nut affixed to the plate whereby under drive actions means the screws are rotated such that the plate is movable upwardly and downwardly on the screws.

4. Apparatus as claimed in claim 1 further comprising two fences for centering and straightening the elements as the elements enter the escapement conveyor.

5. Apparatus as claimed in claim 1, including multiple conveyors for feeding the filling station, each conveyor delivering elements from a different feed to respective movable trays.

6. Apparatus as claimed in claim 1 wherein the movable press further comprising a fence capable of aligning the element relative to the mouth of the container.

7. Apparatus for packing cartons into a basket comprising:

an escapement conveyor for moving the cartons from a delivery conveyor to a movable tray, the escapement conveyor including centering means to align the cartons prior to loading on the movable tray;

the movable tray movable from a loading position remote a basket mouth for delivering a carton load to an unloading position above the basket mouth, said basket being located at a basket filling station;

a movable support at the filling station extending upwardly from a lower position through the basket whereby the free end of the support supports the cartons from underneath on removal of the tray from the filling station;

stop means for cartons loading from the escapement conveyor onto the movable tray prior to movement of the movable tray to the unloading position at the filling station, the stop means including a barrier which is effectively activated by moving at least part of the escapement conveyor transversely to the movement of cartons after a predetermined carton load is delivered to the movable tray;

a movable press for urging the cartons downwardly onto the support and into the basket for a discreet distance after removal of the movable tray, the support moving simultaneously progressively downwardly into the basket, and the press thereupon being upwardly movable after a predetermined press movement whereupon the movable tray, movable support and movable press sequence is repeatable for another carton load to the basket filling station; and a sensor for determining the carton loading state of the basket such that upon a predetermined loading of the basket, the basket is removed from the filling station.

8. Apparatus as claimed in claim 7, wherein the cartons are force fed into the basket in frictional engagement with walls of the basket.

9. Apparatus as claimed in claim 7 including conveyor means for removing a filled basket from the filling station and for locating a further basket at the filling station.

10. Apparatus as claimed in claim 6 wherein a belt for the carton escapement conveyor continues to move below the cartons while the cartons are engaged by the stop means.

11. Apparatus as claimed in claim 10 wherein the conveyor includes two components, one component being stationary and the other being pivotable about one end of the conveyor, the end being the end remote from the movable tray, the pivotable part raising the cartons.

12. Apparatus as claimed in claim 7 wherein the cartons are egg containing cartons and the basket is a metal wire structure.

13. Apparatus as claimed in claim 6 wherein the centering means include longitudinal bars extending substantially parallel to the escapement conveyor and parallel with the conveyor movement, said longitudinal bars being adapted to be located in wells underneath the base cartons.

14. Apparatus for packing cartons into a basket comprising:

an escapement conveyor for moving the cartons from a delivery conveyor to a means for delivering a carton load to an unloading position above a basket mouth, said basket being located at a basket filling station and said escapement conveyor including centering means to align cartons prior to loading onto the delivering means;

movable support tines at the filling station extending upwardly from a lower position through the container whereby the free ends of the tines are adapted to support the cartons from underneath at the filling station, the tines being elongated plates spaced discreetly from each other, and the free ends of the tines being located under grooves in the bottom of the carton;

a movable press for urging the cartons downwardly onto the support and into the basket for a discreet distance, the support tines moving simultaneously progressively downwardly into the basket, and the press thereupon being upwardly movable after a predetermined press movement whereupon a further carton load is delivered to the basket filling station, the movable press comprising a fence capable of aligning the carton relative to the basket mouth; and a sensor for determining the carton loading state of the basket.

15. Apparatus for packing cartons into a basket comprising:

an escapement conveyor for moving the cartons from a delivery conveyor to a movable tray, the escapement conveyor including centering means to align the cartons prior to loading on the movable tray, the centering means including longitudinal bars extending substantially parallel to the escapement conveyor and parallel with the conveyor movement, the longitudinal bars including a discharge end, the discharge end being affixed to a jogging plate thereby rendering the bars relatively flexible transversely to the longitudinal direction, and said longitudinal bars being adapted to be located in wells underneath the base cartons;

the movable tray movable from a loading position remote a basket mouth for delivering a carton load to an unloading position above the basket mouth, said basket being located at a basket filling station;

a movable support at the filling station extending upwardly from a lower position through the basket whereby the free end of the support supports the cartons from underneath on removal of the tray from the filling station;

a movable press for urging the cartons downwardly onto the support and into the basket for a discreet distance after removal of the movable tray, the support moving simultaneously progressively downwardly into the basket, and the press thereupon being upwardly movable after a predetermined press movement whereupon the movable tray, movable support and movable press sequence is repeatable for another carton load to the basket filling station; and a sensor for determining the carton loading state of the basket such that upon a predetermined loading of the basket, the basket is removed from the filling station.

16. Apparatus for packing elements into a container comprising:

an escapement conveyor for moving the elements from a delivery conveyor to a movable tray, the escapement conveyor including centering means to align the elements prior to loading onto the movable tray, the centering means including longitudinal bars extending substantially parallel to the escapement conveyor and parallel with the conveyor movement, the longitudinal bars including a discharge end, the discharge end being affixed to a jogging plate thereby rendering the bars relatively transversely to the longitudinal direction, and said longitudinal bars being adapted to be located in wells underneath the base elements;

the movable tray for delivering the elements from a loading position remote from a container mouth to an unloading position above the container mouth, said container being located at a container filling station;

a movable support at the filling station extending upwardly from a lower position through the container whereby the free end of the support supports the elements from underneath on removal of the tray from the filling station;

a movable press for urging the elements downwardly onto the support and into the container for a discreet distance after removal of the removable tray, the support moving simultaneously progressively downwardly into the container, and the press thereupon being upwardly movable after a predetermined press movement whereupon the movable tray, movable support and movable press sequence is repeatable for another element load to the container filling station; and a sensor for determining the element loading state of the container such that upon a predetermined loading of the container, the container is removed from the filling station.

* * * * *